US010299617B1

(12) United States Patent
Castellanos

(10) Patent No.: US 10,299,617 B1
(45) Date of Patent: May 28, 2019

(54) EXPANDABLE LARGE PACKAGE RECEIVER

(71) Applicant: Pedro Jaime Castellanos, Homestead, FL (US)

(72) Inventor: Pedro Jaime Castellanos, Homestead, FL (US)

( * ) Notice: Subject to any disclaimer, the term of this patent is extended or adjusted under 35 U.S.C. 154(b) by 0 days.

(21) Appl. No.: 16/171,346

(22) Filed: Oct. 25, 2018

(51) Int. Cl.
*A47G 29/14* (2006.01)

(52) U.S. Cl.
CPC ..... *A47G 29/141* (2013.01)

(58) Field of Classification Search
CPC .... A47G 29/124; A47G 29/141; A47G 29/20; A47G 29/22; A47G 29/12; B65D 7/26; B65D 21/086
USPC ..... 232/38, 17, 19, 45, 1 E; 220/6, 8, 476
See application file for complete search history.

(56) References Cited

U.S. PATENT DOCUMENTS 432,254 A * 7/1890 Taylor ..... A47G 29/12 232/19
473,138 A * 4/1892 Anderson ..... A47G 29/12 232/28
476,139 A * 5/1892 Faw ..... A47G 29/12 232/19
2,229,646 A * 1/1941 Firestone ..... A47G 29/1223 220/6
2,750,105 A * 6/1956 Wixom ..... A47G 29/12 232/19
3,802,620 A * 4/1974 Ferrara ..... A47G 29/12 232/19
6,959,858 B2 * 11/2005 Stagnaro ..... A47G 29/12 232/19
9,861,221 B2 * 1/2018 Jiang ..... G06Q 10/0833
10,076,204 B1 * 9/2018 Sadeghi ..... A47G 29/141
2004/0256449 A1 * 12/2004 Stagnaro ..... A47G 29/12 232/28
2005/0224567 A1 * 10/2005 Stagnaro ..... A47G 29/12 232/35
2016/0331171 A1 * 11/2016 Jiang ..... G06Q 10/0833
2018/0228310 A1 * 8/2018 Enobakhare ..... A47G 29/1207

* cited by examiner

*Primary Examiner* — William L Miller
(74) *Attorney, Agent, or Firm* — Ruben Alcoba, Esq.

(57) ABSTRACT

An expandable large package receiver that is placed on a vertical support outside of a business or residence. The expandable large package receiver has a vertical support. A vertical 4-sided frame is mounted on the vertical support. A pair of 4-sided mounts insert within the vertical 4-sided frame. A scissor connector connects the 4-sided mounts to each other when placed within the vertical 4-sided frame. A pair of 4-sided doors, each door attaches to each 4-sided mount. A pair of expandable domed structures, each domed structure attaches to each 4-sided mount via a set of pivots. And, a pair of handles, each handle attaches to each pivot, and each handle moves each pivot in a manner that opens and closes each domed structure.

8 Claims, 6 Drawing Sheets

EXPANDABLE LARGE PACKAGE RECEIVER

BACKGROUND

The present invention is directed to an expandable large package receiver that is placed on a vertical support that is outside a business or residence.

With the explosion of virtual product outlets rather than brick and mortar outlets, a need has been created for having a secure residence or business drop point wherein goods purchased at a virtual product outlet can be left by the shippers of the goods.

The explosion has also created a new breed of criminal that prays on goods delivered in front of residences or businesses while the residents of the residences or the businesses are not present.

Presently, most home mailboxes are not designed to receive large packages. A reason for not designing large package receivers may be that they may be deemed unsightly by some cities or home owner associations.

The inventor of the present invention conceived the invention due to personal experiences that he had when he had products delivered to his home.

The first experience he had was due to a part he had ordered delivered to his home. The part was not delivered because he was not home when the delivery was made and there was no secure place to place the part. The courier delivering the part returned the part to his or her local USPS office and the then the part was misplaced for two months.

The inventor also suffered when deliveries of large packages were made when he was not home. For example, sometimes the courier delivering the packages would simply leave them on the inventor's property with no concern for the items delivered. On the other hand, the inventor's dogs welcomed the packages and either made them chew toys or they would simply mark them with their scents.

The above experiences led the inventor to conceive that there was a need to place a large item delivery container outside of his residence wherein packages could be delivered when he was not home. Yet, his significant other was not thrilled with his first solution, a bulky large package box container. The bulky large package box container was unsightly and was not welcomed in front of his home. So, he was forced to design a slick package container/receiver that could be expanded to accommodate large packages when used.

The inventor realized that his invention, to be marketable, had to be useful to not only the home owners, but also to the shippers of the goods. He realized that his invention would allow online retailers, such as AMAZON, to deliver goods after hours in a secured manner. The benefit of delivering goods after hours would allow couriers to be more efficient in delivering goods and fuel consumption would be reduced because of the efficiency.

During the conception stage of the present invention, the inventor also realized that the package receiver had to be designed to foresee dangers that could be associated with the package receiver, for example, a child entering the package receiver and locking him or herself inside during a hot summer day. He realized that the receiver had to be designed to allow air to enter the receiver and that the temperature within the receiver had to be naturally controlled. He also realized that he had to allow hot air to escape from within the receiver, yet rain could not go within the receiver when in use. The present invention is designed to allow the stack effect to expel hot air from within the receiver.

For the foregoing reasons, there is a need for an expandable large package receiver that is placed alongside a vertical support that is outside a business or residence, that will be slightly, that will prevent theft, that will prevent animals from destroying or marking packages left outside of homes, and that will be safe for living beings accidentally locked within the receiver.

SUMMARY

The present invention is an expandable large package receiver that is placed on a vertical support that is outside of a business or residence. The expandable large package receiver has a vertical support. A vertical 4-sided frame is mounted on the vertical support. A pair of 4-sided mounts insert within the 4-sided frame. A scissor connector connects the 4-sided mounts to each other when placed within the 4-sided frame. A pair of 4-sided doors, each door attaches to each 4-sided mount. A pair of expandable domed structures, each domed structure attaches to each 4-sided mount via a set of pivots. And, a pair of handles, each handle attaches to each pivot, and each handle moves each pivot in a manner that opens and closes each domed structure.

The domed structure uses a louver system to open and close. The louver system ensures that air passes through the domed structure when the domed structure is opened to secure a package within the expandable large package receiver.

An object of the present invention is to provide expandable large package receiver that will allow large packages to be securely left outside a business or residence.

Another object of the present invention is to provide an expandable large package receiver that will allow large packages to not be damaged when left outside of a home or residence.

Yet another object of the present invention is to provide an expandable large package receiver that will be sightly.

A further object of the present invention is to provide an expandable large package receiver that will allow large packages to be securely left outside of homes after normal business hours.

Yet still another object of the present invention is to provide an expandable large package receiver that will not endanger the life of any being accidently locked within the receiver.

DRAWINGS

These and other features, aspects, and advantages of the present invention will become better understood with regards to the following description, appended claims, and drawings where:

FIG. 1 shows a perspective view of the present invention;

FIG. 2 shows a perspective view of the present invention wherein one f the domed structures is partially shown to show how the scissor connector attaches to the vertical 4-sided frame and to the 4-sided mounts, the figure also shows the scissor connector in an expanded position, this allows the expandable large package receive to be expanded outwardly by approximately 5 to 5.5 to inches from a central position of 4-sided frame;

DESCRIPTION

Figure 1:
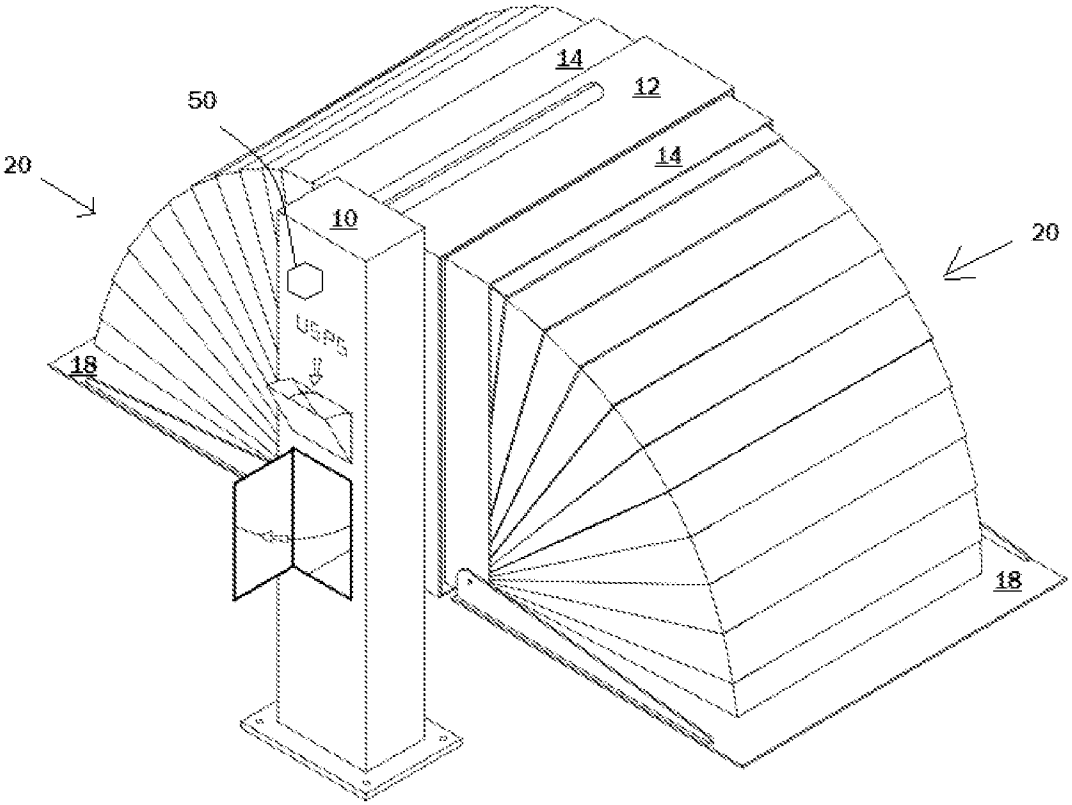
Figure 2:
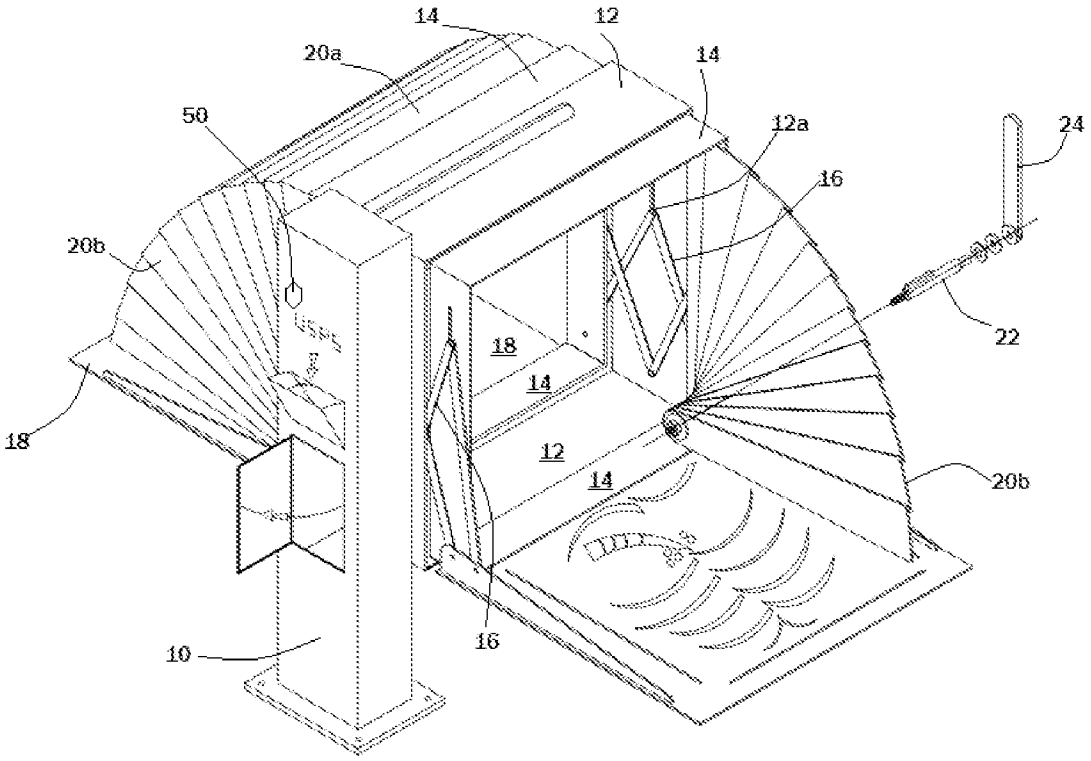
Figure 3:
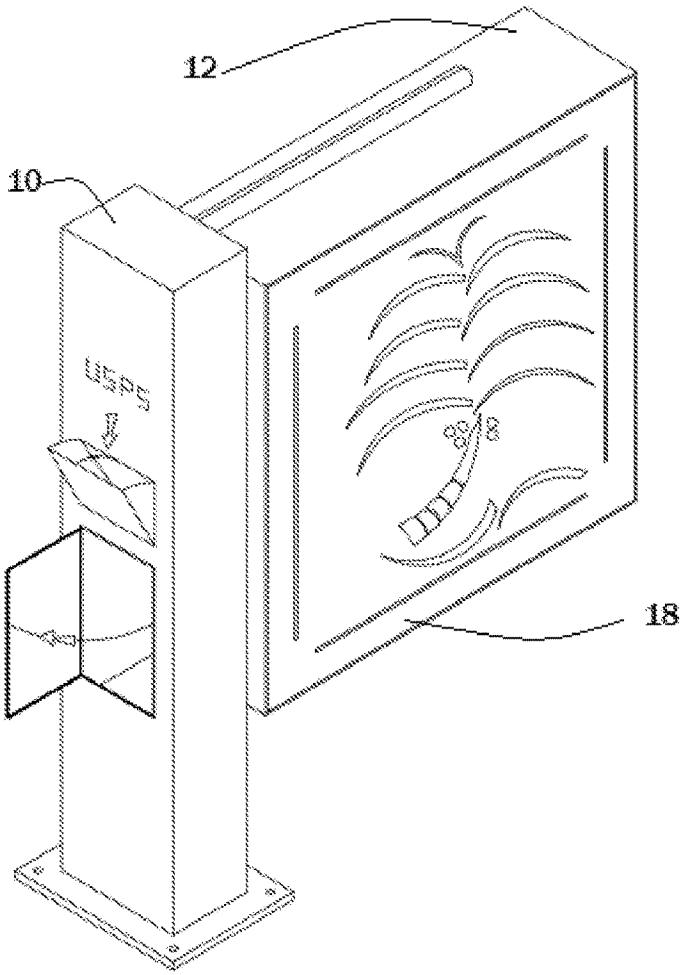
FIG. 3 shows a perspective view of the present invention wherein the doors of the invention are in close position and the domed structure is retracted.
Figure 4:
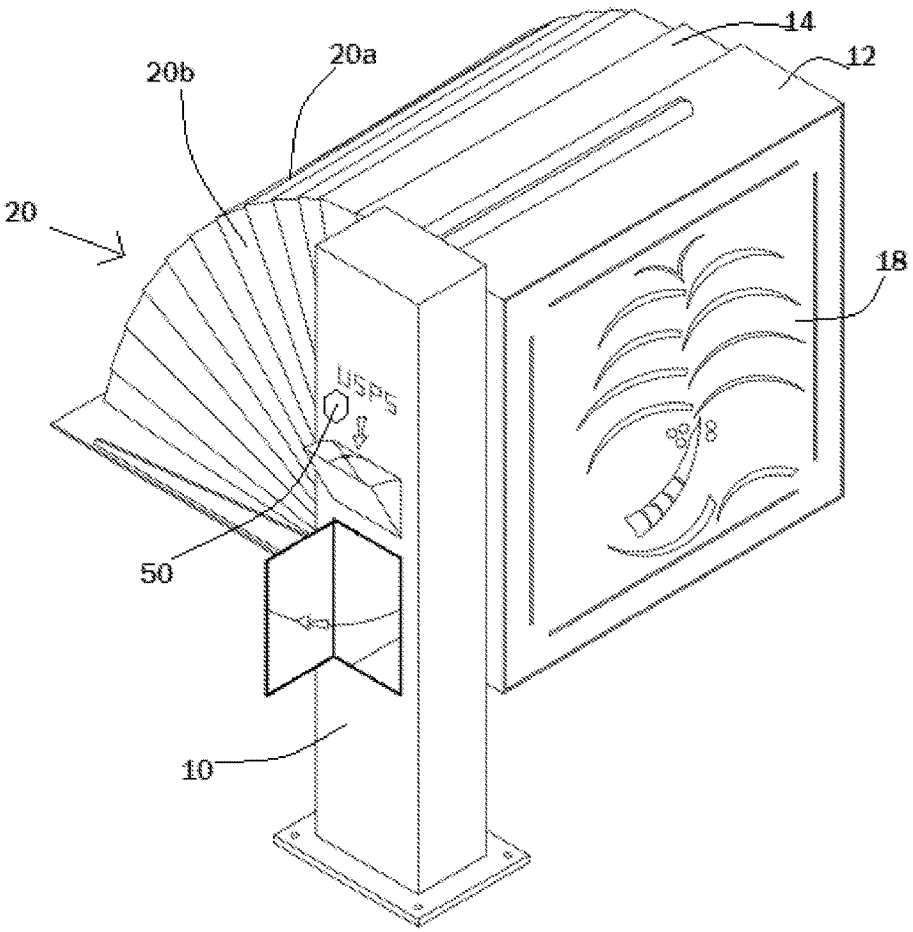
FIG. 4 shows a perspective view of the present invention wherein only one door is in the opened position and only one domed structure is in the opened position.
Figure 5:
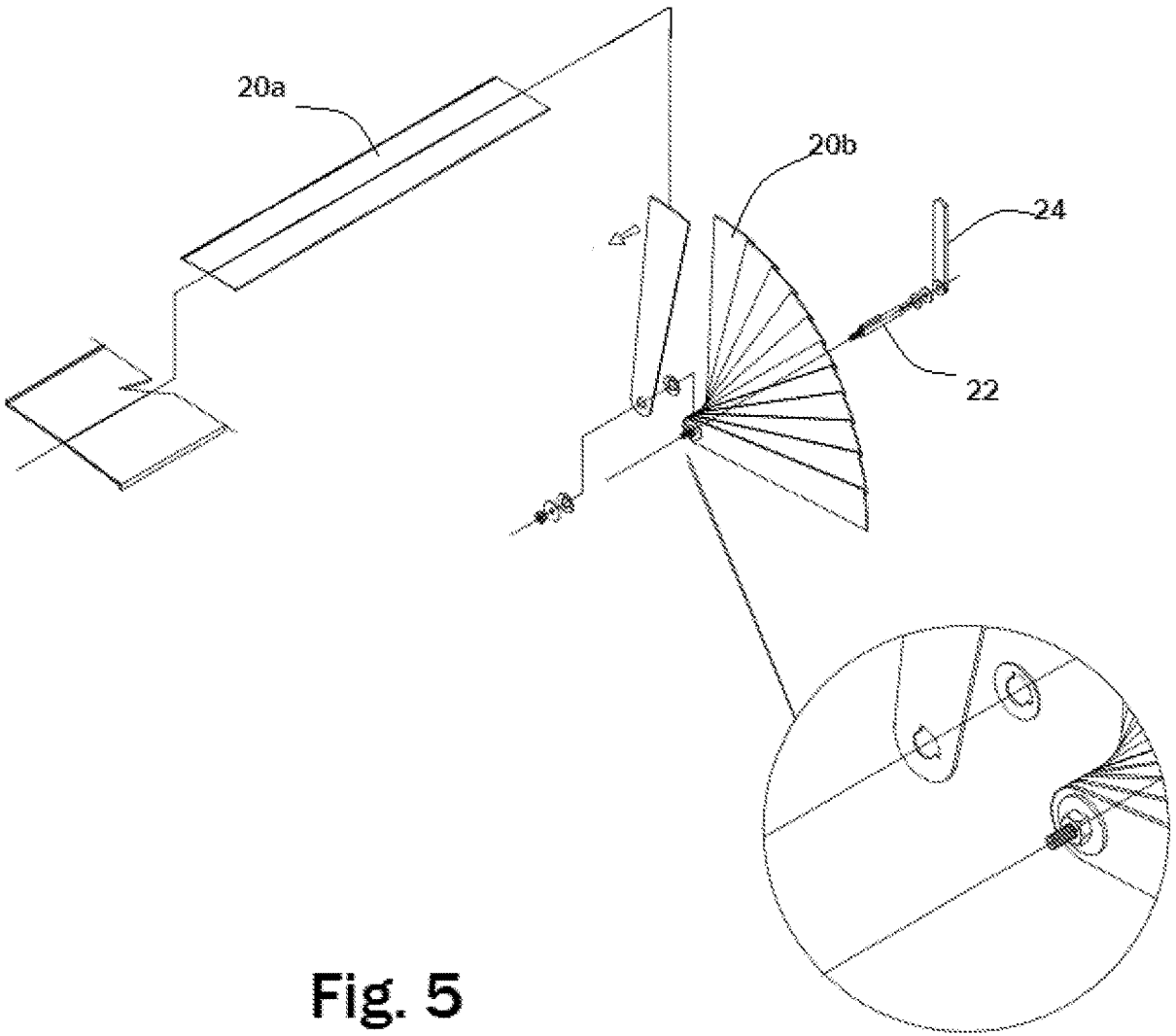
FIG. 5 shows a perspective view of that shows how the louvers of the domed structure are mounted on the pivot that is attached to the handle of the present invention.
Figure 6:
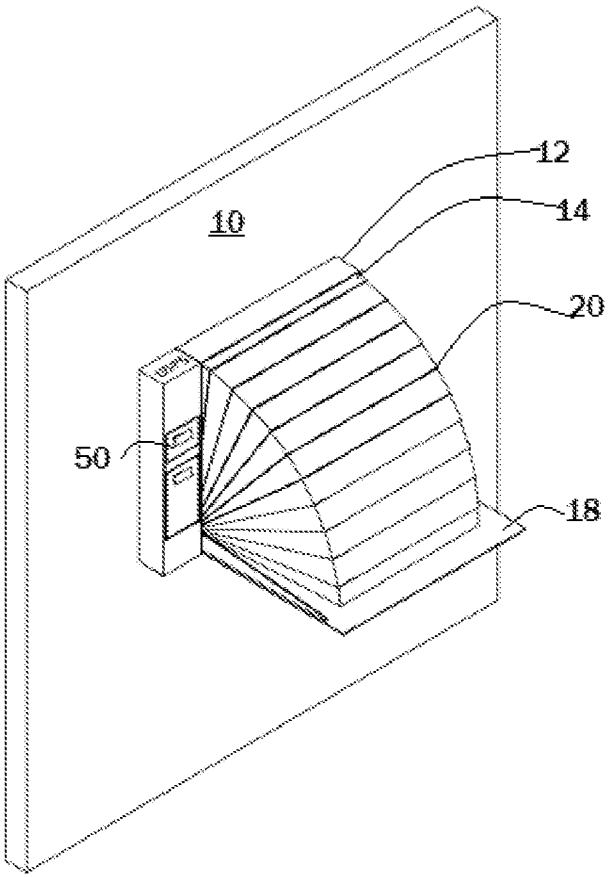
FIG. 6 shows a perspective view of one of the embodiments of the present invention when the invention is attached to an exterior wall of a fixed structure.

As seen in FIGS. 1-12 the present invention is an expandable large package receiver that is placed on a vertical support outside of a business or residence. The expandable large package receiver comprises a vertical support 10. A vertical 4-sided frame 12 that Is mounted on the vertical support 10. A pair of 4-sided mounts 14 insert within the 4-sided frame 12. A scissor connector 16 that connects the 4-sided mounts 14 to each other when placed within the 4-sided frame 12. A pair of 4-sided doors 18, each door 18 attaches to each 4-sided mount 14. A pair of expandable domed structures 20, each domed structure 20 attaches to each 4-sided mount 14 via a set of pivots 22. And, a pair of handles 24, each handle 24 attaches to each pivot 22, and each handle 24 moves each pivot 22 in a manner that opens and closes each domed structure.

The scissor connector 16 attaches to the vertical 4-sided frame 12 in a manner that each outer side of the scissor connector is equally distanced from a central attachment point 12*a* of the vertical 4-sided frame 12.

In a preferred embodiment of the present invention the vertical support 10 is a mail post. The vertical 4-sided frame 12 has a width of 12 inches, a length of 40 inches and a height of 40 inches. The pair of 4-sided mounts 14 have a width of 6 inches, a length of 39.75 inches and a height of 39.75 inches. And, the pair of expandable domed structures 20 comprise of multiple louvers 20*a* that have side walls 20*b*, each louver 20*a* pivots on the pivot 22 and each louver 20*a* is designed to fit within the adjoining louver 20*a* when the domed structure 20 is in an opened position. When each expandable domed structure 20 is in the opened position there is an opening of between ⅛ of an inch to ⅜ of an inch between each louver 20*a*.

An embodiment of the present invention shall also include a set of locks 50 that lock the expandable domed structure in the locked position when the domed structures 20 are in an opened position. In another embodiment of the present invention, the locks 50 shall have a unique identifier that can be unlocked via a radio frequency code.

In preferred embodiments of the present invention, the domed structure shall be made of a material that minimizes heat transfer, for example, fiberglass or any other material know in the art of minimizing heat transfer.

An advantage of the present invention is that it provides and expandable large package receiver that allows large packages to be securely left outside a business or residence.

Another advantage of the present invention is that it provides an expandable large package receiver that allows large packages not to be damaged when left outside of a home or residence.

Yet another advantage of the present invention is that it provides an expandable large package receiver that is sightly.

A further advantage of the present invention is that it provides an expandable large package receiver that allows large packages to be securely left outside of homes after normal business hours.

Yet still another advantage of the present invention is that it provides expandable large package receiver that does not endanger the life of any being accidently locked within the receiver.

While the inventor's above description contains many specificities, these should not be construed as limitations on the scope, but rather as an exemplification of several preferred embodiments thereof. Many other variations are possible. Accordingly, the scope should be determined not by the embodiments illustrated, but by the appended claims and their legal equivalents.

What is claimed is:

1. An expandable large package receiver that is placed on a vertical support outside of a business or residence, the expandable large package receiver comprises:

the vertical support;

a vertical 4-sided frame that is mounted on the vertical support;

a pair of 4-sided mounts inserted within the vertical 4-sided frame;

a scissor connector that connects the 4-sided mounts to each other when placed within the vertical 4-sided frame;

a pair of 4-sided doors, each door attaches to the respective 4-sided mount;

a pair of expandable domed structures, each domed structure attaches to each 4-sided mount via a set of pivots; and a pair of handles, each handle attaches to each pivot, and each handle moves each pivot in a manner that expands each domed structure to an opened position and retracts each domed structure to a closed position.

2. The expandable large package receiver that is placed on a vertical support outside of a business or residence of claim 1, wherein the scissor connector attaches to the vertical 4-sided frame in a manner that each outer side of the scissor connector is equally distanced from a central attachment point of the vertical 4-sided frame.

3. The expandable large package receiver that is placed on a vertical support outside of a business or residence of claim 2, wherein:

the vertical support is a mail post;

the vertical 4-sided frame has a width of 12 inches, a length of 40 inches and a height of 40 inches;

the pair of 4-sided mounts have a width of 6 inches, a length of 39.75 inches and a height of 39.75 inches; and the pair of expandable domed structures each comprise multiple louvers that have side walls, each louver pivots on the pivot and each louver is designed to fit within the adjoining louver when the domed structure is in the opened position.

4. The expandable large package receiver that is placed on a vertical support outside of a business or residence of claim 3, wherein there is an opening of between ⅛ of an inch to ⅜ of an inch between each louver when each expandable domed structure is in the opened position.

5. The expandable large package receiver that is placed on a vertical support outside of a business or residence of claim 4, comprising of a set of locks that lock the expandable domed structure in a locked position when the domed structures are in the opened position.

6. The expandable large package receiver that is placed on a vertical support outside of a business or residence of claim 5, wherein the lock has a unique identifier that can be unlocked via a radio frequency code.

7. The expandable large package receiver that is placed on a vertical support outside of a business or residence of claim 6, wherein the domed structure is made of a material that minimizes heat transfer.

8. An expandable large package receiver that is placed on the vertical support outside of a business or residence, the expandable large package receiver comprises:

a vertical support that is a wall structure;

a vertical 4-sided frame that is mounted on the vertical support;

a 4-sided mount inserts within the vertical 4-sided frame;

a scissor connector that connects the 4-sided mount to the wall structure when the 4-sided mount is placed within the vertical 4-sided frame;

a 4-sided door that attaches to the 4-sided mount;

an expandable domed structure that attaches to the 4-sided mount via a set of pivots; and a handle that attaches to the pivots, and the handle moves the pivots in a manner that expands the domed structure to an opened position and retracts the domed structure to a closed position.

* * * * *